US007433629B2

(12) United States Patent
Tomatsu

(10) Patent No.: US 7,433,629 B2
(45) Date of Patent: Oct. 7, 2008

(54) OPENING AND CLOSING MECHANISM AND IMAGE RECORDING APPARATUS HAVING THE SAME

(75) Inventor: Yoshiya Tomatsu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 23 days.

(21) Appl. No.: 11/196,264

(22) Filed: Aug. 4, 2005

(65) Prior Publication Data

US 2006/0029425 A1 Feb. 9, 2006

(30) Foreign Application Priority Data

Aug. 4, 2004 (JP) ..... 2004-228488

(51) Int. Cl.
*G03G 15/00* (2006.01)
*E05F 5/06* (2006.01)

(52) U.S. Cl. ..... 399/125; 16/85

(58) Field of Classification Search ..... 399/125; 16/85

See application file for complete search history.

(56) References Cited

U.S. PATENT DOCUMENTS 4,096,602 A * 6/1978 Nelson ..... 16/85
2002/0114640 A1* 8/2002 Nobe et al. ..... 399/110

FOREIGN PATENT DOCUMENTS

JP 10098278 4/1998

* cited by examiner

*Primary Examiner*—David M Gray
*Assistant Examiner*—Joseph S. Wong
(74) *Attorney, Agent, or Firm*—Banner & Witcoff, Ltd

(57) ABSTRACT

An opening and closing mechanism that attaches a cover body to a main body in a manner that the cover body is pivotably opened and closed, includes: a pin provided in one of the main body and the cover body; a link member pivotably provided in the other of the main body and the cover body, the link member having a first guide groove in which the pin is inserted and the pin slides during closing and opening of the cover body with respect to the main body; and a close motion braking member that is a separate member from the pin and the link member and is connected to the link member. The close motion braking member applies an external force to the link member to brake sliding of the pin in the first guide groove during closing of the cover body.

20 Claims, 6 Drawing Sheets

OPENING AND CLOSING MECHANISM AND IMAGE RECORDING APPARATUS HAVING THE SAME

BACKGROUND OF THE INVENTION

1. Field of the Invention

The present invention relates to an opening and closing mechanism provided between a main body and a cover body pivotably attached to the main body, and more particularly, to an opening and closing mechanism applied between a main body and a cover body, for example, of an image recording apparatus.

2. Description of the Related Art

As a structure in which a cover body is pivotably attached to a main body so as to be opened and closed, for example, an image recording apparatus is known. In the image recording apparatus, the main body is provided with a sheet feed cassette, etc., and the cover body is provided with an original reader, etc. In this image recording apparatus, handling a paper jam occurred inside the main body, maintaining a recording head unit and exchanging ink cartridges, and so on, are carried out in a state where the cover body is opened. Further, for the purpose of this maintenance, an opening angle of the cover is set up so as to be opened at a large angle, because an operator needs to insert his/her hand into the main body.

Since a variety of mechanisms are usually mounted in the cover body, the cover body has a relatively heavy weight. Thus, it is desired that the cover body, when closed, gradually descends in order to prevent fingers of the operator from being caught and to prevent dislocation or damage of built-in parts (precision parts such as a mirror, CCD (Charge Coupled Device), etc.) caused by impact. In contrast, it is desired that the cover body be operated with a weak force when opening the cover body.

For example, JP-A-10-98278 (see FIG. 4) discloses a link member (corresponding to a stopper of JP-A-10-98278) attached to a cover body and having a groove the width of which gradually decreases, and a pin provided in a main body and fitted into the groove. The pin slides relative to the stopper along the groove when the cover body is closed and gradually enters a portion of the groove with the narrow width. With this configuration, as the cover body is closed, braking against movement of the pin is gradually increased, and thus the cover body descends slowly.

SUMMARY OF THE INVENTION

In the structure disclosed in JP-A-10-98278, in the case of opening the cover body, the pin moves relative to the stopper in a direction opposite to the closing direction. In other words, the pin moves relative to the stopper in the direction along which the width of the groove is gradually widened. Therefore, the operator can open the cover body with a weak force (light load). However, in the case of closing the cover body, since the pin needs to be pressed into the gradually narrowed groove, it is necessary to gradually apply a strong force to press (descend) the cover body as the cover body is closed. This deteriorates the operability.

The present invention provides an opening and closing mechanism which has a simple configuration and is capable of preventing a cover body from being suddenly closed with respect to a main body, and which is operated with a weak force when opening the cover body. The present invention also provides an image recording apparatus having the opening and closing mechanism.

According to one aspect of the invention, there is provided an opening and closing mechanism that attaches a cover body to a main body in a manner that the cover body is pivotably opened and closed, including: a pin provided in one of the main body and the cover body; a link member pivotably provided in the other of the main body and the cover body, the link member having a first guide groove in which the pin is inserted and the pin slides during closing and opening of the cover body with respect to the main body; and a close motion braking member that is a separate member from the pin and the link member and is connected to the link member. The close motion braking member applies an external force to the link member to brake sliding of the pin in the first guide groove during closing of the cover body.

According to another aspect of the invention, there is provided an image recording apparatus including: a main body; a cover body; and the above-described opening and closing mechanism.

According to the above structure, the cover body is prevented from being suddenly closed with respect to the main body. Also, opening operation of the cover body can be easily and smoothly conducted.

BRIEF DESCRIPTION OF THE DRAWINGS

The present invention may be more readily described with reference to the accompanying drawings.

DETAILED DESCRIPTION OF THE PREFERRED EMBODIMENTS

Hereinafter, an embodiment of the present invention will be described in detail with reference to the accompanying drawings.

Figure 1:
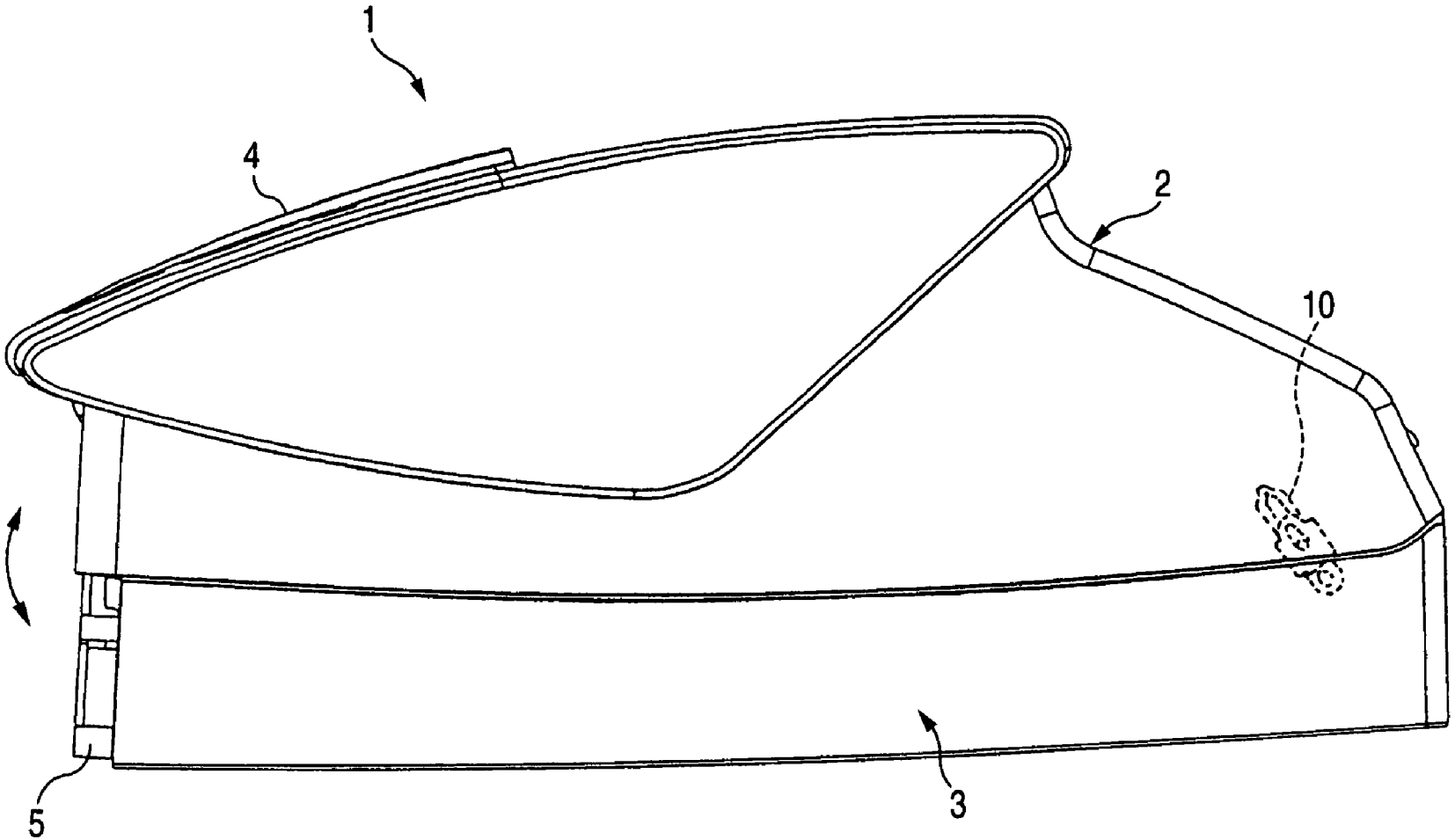
FIG. 1 is a side view of an image recording apparatus to which an opening and closing mechanism according to a first embodiment of the invention is applied.

As shown in FIG. 1, an opening and closing mechanism 10 according to a first embodiment of the invention is applied to an image recording apparatus 1 having various functions such as printer function, copier function, scanner function, facsimile function or the like. A cover body 2 is attached to a main body 3 through a hinge 6 (see FIG. 2A) to be pivotably opened and closed up and down. When the cover body 2 is opened, a left side in FIG. 1 is opened.

The cover body 2 has an operation panel 4 disposed on an upper surface thereof. The operation panel 4 is provided with various operation buttons and a liquid crystal display. In addition, although not shown, an original reader, a glass plate on which an original is placed and an image scanner device (CIS (Contact Image Sensor)) for reading the original are mounted in the cover body 2 for the copier and facsimile functions.

A sheet feed cassette 5 is detachably inserted into the main body 3 from a front side (the left side in FIG. 1) of the main body 3. Although not shown, a transport path through which a sheet (recording medium) fed from the sheet feed cassette 5 is transported to a recording head unit is formed in the main body 3 at a rear side of the sheet feed cassette 5 (a right side in FIG. 1). Also, the recording head unit that records an image on the sheet is mounted in the main body 3. Further, ink cartridges that supply ink to the recording head unit are accommodated in the main body 3.

Figure 2A:
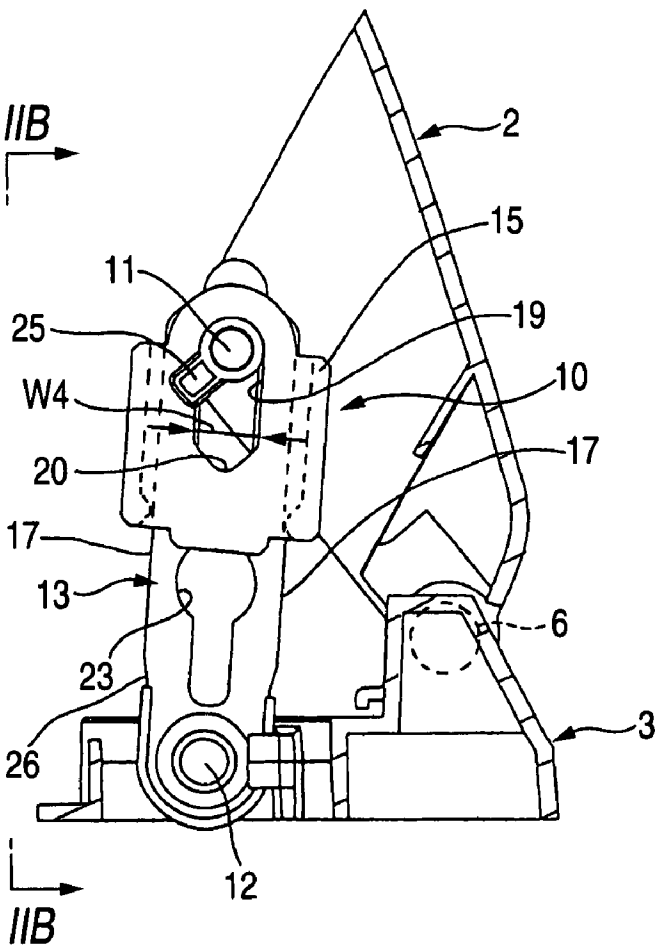
FIG. 2A is a side view of the opening and closing mechanism.
Figure 2B:
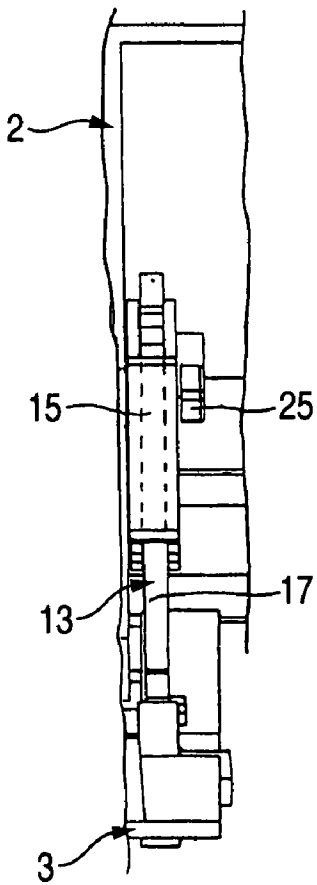
FIG. 2B is a view taken along line IIB-IIB of FIG. 2A.
Figure 3:
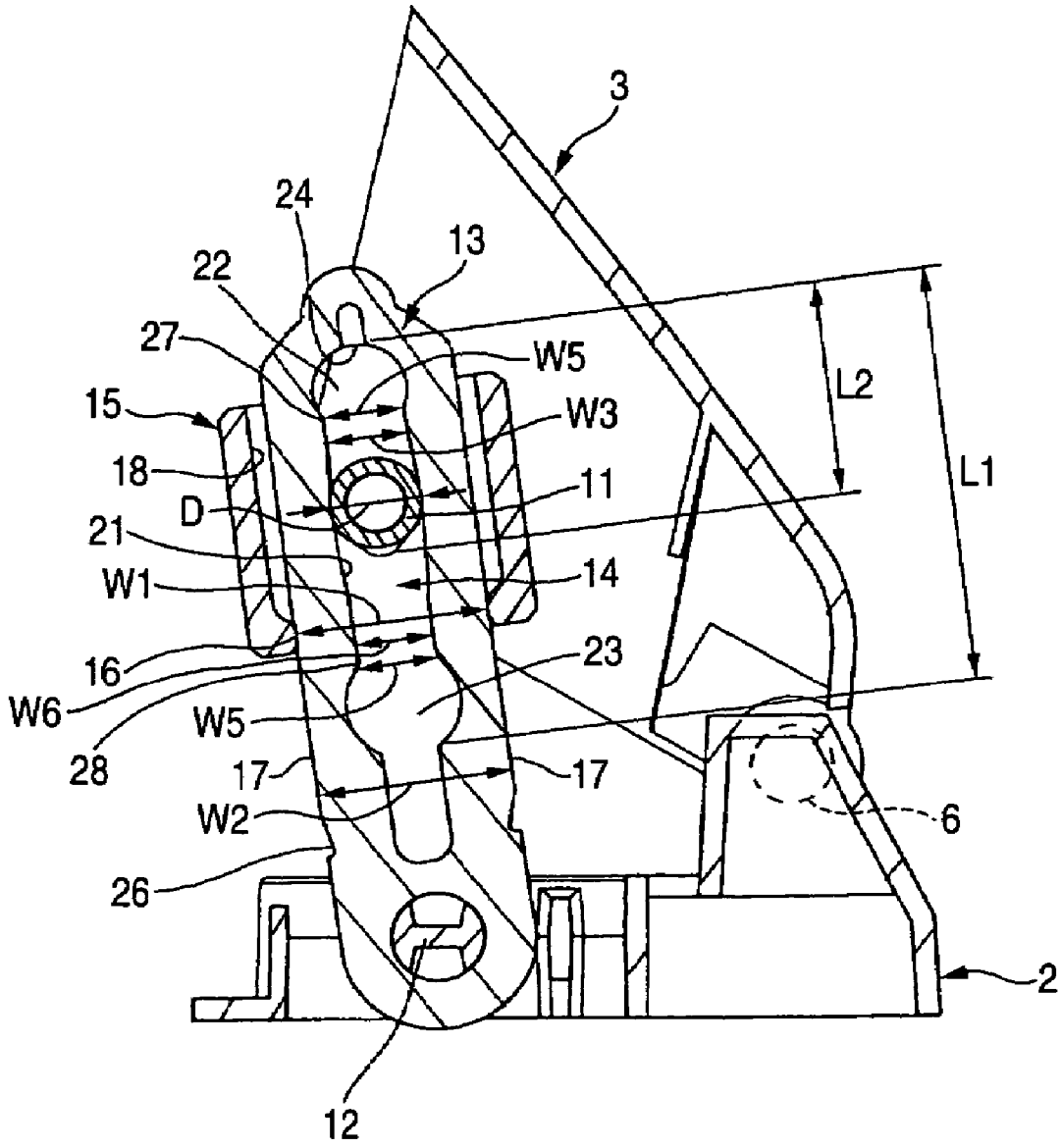
FIG. 3 is a cross-sectional view for explaining an assembly of a link member and a brake member.

As shown in FIGS. 2A, 2B and 3, the opening and closing mechanism 10 of this embodiment includes a pin 11 provided in the cover body 2, a link member 13 provided in the main body 3 to be pivotable about a pivot shaft 12, and a brake member 15. The pin 11 is slidably fit in a first guide groove 14 that has a substantially oblong shape and is formed to penetrate the link member 13, thereby guiding the brake member 15 so as to move along the link member 13. The link member 13 is shaped in a substantially flat, elongate plate of a synthetic resin, which can be elastically deformed, and is provided with the pivot shaft 12 on a base end thereof. The first guide groove 14 is formed in a wide surface of the link member 13 and extends along a length direction of the link member 13.

The brake member 15 includes a brake part 16 that restricts movement of the pin 11 guided along the first guide groove 14. The brake member 15 is externally fit on the link member 13 so as to be movable toward and away from the pivot shaft 12. The brake part 16 is provided on a brake member end portion on the side of the pivot shaft 12. The brake part 16 pinches side surfaces (narrow surfaces) 17 of the link member 13, which oppose to each other along the length direction.

In this embodiment, the brake member 15 is formed of synthetic resin and has an angled tubular shape to be fit on the link member 13. A passage hole 18 in which the link member 13 is loosely fit is formed in the brake member 15 along a direction perpendicular to a plate thickness direction of the brake member 15. Further, a wide surface of the brake member 15 has a second guide groove 19 that penetrates the brake member 15 and overlaps with the first guide groove 14 of the link member 13. The second guide groove 19 is formed in a substantially oblong shape with its length direction matched with that of the first guide groove 14 of the oblong shape. A length dimension L2 of the second guide groove 19 is smaller than a length dimension L1 of the first guide groove 14 (L2<L1). The second guide groove 19 is located at a center of the wide surface of the brake member 15 and extends linearly from a part near the brake part 16 to a part far from the brake part 16. For the sake of convenience, with regard to the second guide groove 19, part of the inner wall near the brake part 16 is defined as "a lower inner wall 20," and another part of the inner wall far from the brake part 16 is defined as "an upper inner wall 24."

The pin 11 is inserted in the region where the first guide groove 14 overlaps with the second guide groove 19. Further, a tip end of the pin 11 is formed with an engaging piece 25 so as to prevent the brake member 15 and the pin 11 from coming off the first and second guide grooves 14 and 19.

The brake part 16 has hook-like portions that inwardly protrude from the end portion on the side of the pivot shaft 12 in the passage hole 18 to decrease a width dimension of the passage hole 18. Tip ends of the hook-like portions of the brake part 16 come into contact with the side surfaces 17 of the link member 13 inserted in the passage hole 18, and thereby the brake part 16 pinches the link member 13 in a width direction perpendicular to the length direction. A gap in the brake part 16, namely a distance W1 between the tip ends of the hook-like portions is set to be smaller than a distance between the opposing side surfaces 17 and 17 (i.e., a width dimension W2 of the link member 13) at a region where the brake member 15 slides (W1<W2).

Further, each of the side surfaces 17 and 17 is formed with a stopper 26 that is recessed to prevent the brake member 15 from moving beyond a predetermined position adjacent to the pivot shaft 12. The stopper 26 is slanted to help the brake member 15 to slide away from the pivot shaft 12. Alternatively, the stopper 26 may have a protrusion shape.

The first guide groove 14 has the substantially oblong shape as mentioned above, and more particularly, includes a linear sliding part 21 in which the round shaft or cylindrical pin 11 slides, an opening holding part 22 of a substantially circular shape which communicates with an end of the sliding part 21 remote from the pivot shaft 12 through an upper narrowed part 27, and a closing holding part 23 of a substantially circular shape which communicates with an end of the sliding part 21 near the pivot shaft 12 through a lower narrowed part 28. The sliding part 21 has a width dimension W3 greater than a width dimension W5 of each of the upper and lower narrowed parts 27 and 28, and smaller than a diameter D of the pin 11 (W5<W3<D). Further, both of the opening and closing holding parts 22 and 23 have a diameter formed to be greater than the width dimension W3 of the sliding part 21. At the sliding part 21, the inner walls are elastically deformed when the pin 11 is inserted to magnify the width dimension W3. It is possible to set the width dimension of the sliding part 21 on the side of the opening holding part 22 to W3, and to set the width dimension of the sliding part 21 on the side of the closing holding part 23 to W6. In this case, the closing speed of the cover body 2 can be adjusted by adjusting the setup of the width dimensions W3 and W6. In order to facilitate braking against the pin 11, it is desirable to set up the following relationship: W3≧W6.

The second guide groove 19 has a width dimension W4 that is greater than the width dimension W3 of the first guide groove 14 and the diameter D of the pin 11, so that the pin 11 slides along the first guide groove 14 (W4>D>W3). As the cover body 2 is pivoted in the closing direction, the pin 11 comes into contact with the lower inner wall 20 of the second guide groove 19, the pin 11 presses the brake member 15 to slide toward the pivot shaft 12. In this state, the pin 11 is likely to relatively vibrate in the width direction of the second guide groove 19. In other words, the brake member 15 is likely to resonate on the brake part 16 as a fulcrum. Thus, to prevent this phenomenon, the lower inner wall 20 is formed to have such a shape as to prevent the brake member 15 from moving in the width direction of the pin 11. In this embodiment, the lower inner wall 20 is formed to have a V shape in a plan view on the wide surface, and to come into contact with an outer circumference of the circular cross-sectional pin 11 at a symmetrical positions about the central axis of the pin 11.

Figure 4A:
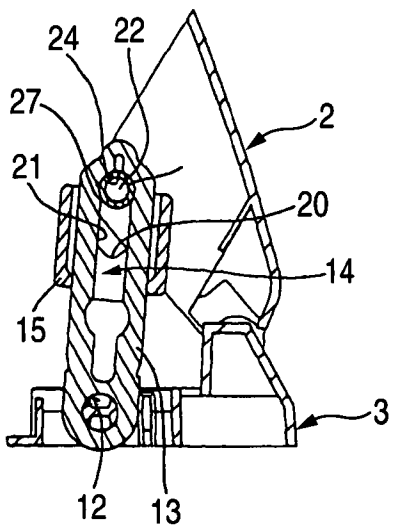
FIGS. 4A to 4D are views for explaining an opening operation and a closing operation of a cover body.

According to the above-described configuration, as shown in FIG. 4A, when the cover body 2 is opened (opened wide) relative to the main body 3, the pin 11 is brought into contact with the upper inner wall 24 of the second guide groove 2 and located at the opening holding part 22 of the first guide groove 14. Further, because the first guide groove 14 has the upper narrowed part 27 formed between the opening holding part 22 and the sliding part 21, the pin 11 is stably maintained in the opening holding part 22, and the cover body 2 is kept opened while an operator conducts necessary maintenance work. In that situation, the pin 11 is located on the upper end side of the second guide groove 19 in the brake member 15. In other words, the brake member 15 is pulled up to the upper end side of the link member 13.

Figure 4B:
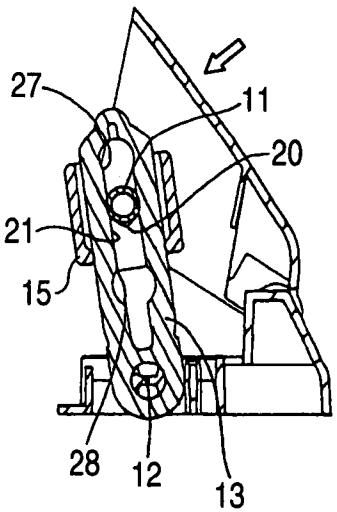

When a force is applied to the cover body 2 in the closing direction, as shown in FIG. 4B, the pin 11 moves from the opening holding part 22 to the sliding part 21 through the upper narrowed part 27. Because the pin 11 passes through the upper narrowed part 27 when moving into the sliding part 21, the pin 11 gives a tactile response to the operator as the closing operation of the cover body 2 is started.

While the cover body 2 is closed by its self-weight, the pin 11 moves toward the pivot shaft 12. Here, since the diameter D of the pin 11 is greater than the width dimension W3 of the sliding part 21, the link member 13 on both opposing sides of the sliding part 21 undergoes partial elastic deformation, and thereby the pin 11 slides on the sliding part 21 while increasing the width of the sliding part 21. Further, since the diameter D of the pin 11 is smaller than the width dimension W4 of the second guide groove 19, the brake member 15 maintains a position as shown in FIG. 4A, with respect to the link member 13, until the pin 11 moves to come into contact with the lower inner wall 20 of the second guide groove 19.

Since the brake part 16 pinches the side surfaces 17, 17 of the link member 13 from the outside with the gap W1, which is smaller than the width dimension W2 of the link member 13, the brake part 16 exerts a force to prevent the sliding part 21 from being widened by the pin 11. Moreover, because a braking force is increased as the pin 11 approaches the brake part 16 (the braking force is inversely proportional to the cube of the distance between the brake part 16 and the pin 11), the braking action is gradually increased to decrease the closing speed of the cover body 2 as the pin 11 approaches the pivot shaft 12. When the pin 11 is brought into contact with the lower inner wall 20 of the second guide groove 19, the braking action caused by the brake part 16 becomes maximum. When the operator applies additional force in the closing direction, the pin 11 further moves closer to the pivot shaft 12. After the pin 11 comes into contact with the lower inner wall 20, the braking force in this state is maintained, and thus the movement speed of the cover body 2 in the closing direction is slow. As a result, the pin 11 moves together with the brake member 15 until it reaches the lower narrowed part 28 in a state in contact with the lower inner wall 20.

Figure 4C:
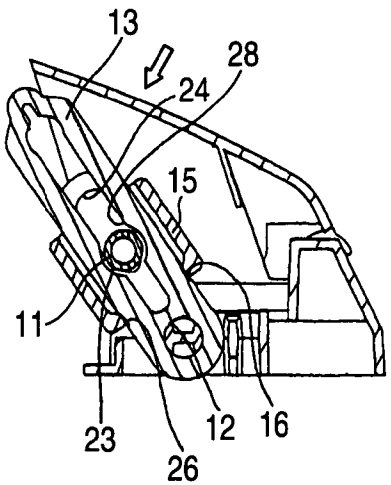

When the pin 11 reaches the lower narrowed part 28, and comes to a stop, the operator further applies a force to the cover body 2 in the closing direction until the tactile response is given. Then, as shown in FIG. 4C, the pin 11 arrives at the closing holding part 23 and the brake part 16 is inserted in the stopper 26. Thereby, the cover body 2 is completely closed relative to the main body.

On the contrary, when the operator pulls up the cover body 2 with a weak force to open the cover body 2, the pin 11 moves from the closing holding part 23 to the sliding part 21 through the lower narrowed part 28 while giving tactile response to the operator.

Figure 4D:
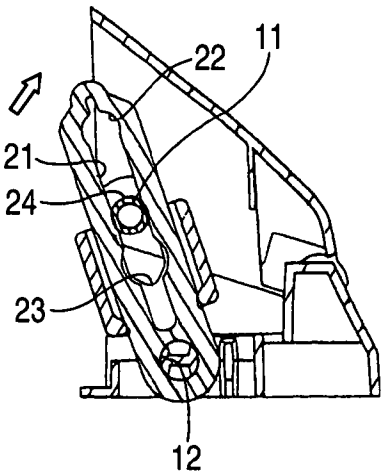

As the pin 11 moves on the sliding part 21 to get away from the pivot shaft 21, the braking action caused by the brake part 16 is decreased. Namely, a restraining force of the brake part 16 against the increase of the width dimension of the sliding part 21 caused by the pin 11 is gradually reduced as the pin 11 moves away from the brake part 16 (the braking force is inversely proportional to the cube of the distance between the brake part 16 and the pin 11). Also, as shown in FIG. 4D, when coming into contact with the upper inner wall 24 of the second guide groove 19, the pin 11 moves to get away from the pivot shaft 12 together with the brake member 15 while pressing the upper inner wall 24 in a state where the braking action (braking force) against the movement of the pin 11 is weakened. Thus, the operator can pull up and open the cover body 2 with a light load. Further, when the pin 11 reaches the opening holding part 22, the cover body 2 is completely opened, and this state is maintained.

In this manner, in the opening and closing mechanism 10 according to the first embodiment, when the cover body 2 is closed, the braking force against movement of the pin is increased so that the closing speed becomes gradually decreased. Thus, there is no fear that the operator's fingers are pinched by the cover body or any precision parts are damaged by impact.

Further, since the brake member 15 is constructed to slide on the link member 13, the cover body 2 can be closed with the braking force against movement of the pin 11 maintained at a constant level. In other words, because the braking force is not increased more than needs, the operator does not need to use a strong force when closing the cover body 2. This leads to an excellent operability.

Furthermore, because a proper tactile response is given while conducting the opening or closing of the cover body 2, the operator can easily confirm that the cover body reaches to a predetermined position.

Also, since the lower inner wall 20 of the second guide groove 19 is formed in the V shape and pressed at a symmetrical positions about the axis of the pin 11, the brake member 15 is subject to no displacement or vibration in the width direction of the second guide groove 19, and is linearly guided toward the pivot shaft 12. As a result, even when the brake member 15 moves together with the pin 11, vibration of the brake member 15 caused by friction can be prevented, so that it is possible to prevent noise from occurring. Moreover, when materials having a natural frequency different from each other are used for the brake member 15 and the link member 13 respectively, their resonance is prevented, and thereby the effect of preventing the noise is improved. For example, the brake member 15 may be made of ABS (acrylonitrile-butadiene-styrene) resin and the link member 13 may be made of POM (polyoxymethylene).

The connection region between the first guide groove 14 and the closing holding part 23 is formed with the lower narrowed part 28. Alternatively, the lower narrowed part 28 may be eliminated.

In addition, in order to stably maintain the state where the pin 11 is located in the opening holding part 22 and the brake member 15 is pulled up to the upper end side of the link member 13 by the pin 11, a stopper which prevents falling of the brake member 15 may be provided on the opposing side surfaces 17 at appropriate positions.

Also, the first guide groove 14 has the opening holding part 22 which holds the cover body 2 in the opened state, and which is located at one end of the first guide groove 14 remote from the pivot shaft 12 and formed into the substantially circular shape. Thus, the cover body 2 is stably supported in the opened state.

Further, the first guide groove 14 has the closing holding part 23 which holds the cover body 2 in the closed state, and which is located at the other end of the first guide groove 14 close to the pivot shaft 12 and formed into the substantially circular shape. Therefore, the cover body 2 can be kept in the closed state without requiring additional locking parts.

Additionally, the pin 11 has the engaging piece 25 that prevents the pin 11 from coming off the first guide groove 14, so that reliable opening and closing operation of the cover body 2 can be conducted.

Also, the brake member 15 is externally fit on the link member 13 and is slid on the link member 13 in accordance with the movement of the pin 11 relative to the link member 13. This structure can be assembled relatively easily.

Further, the brake member 15 has the brake part 16 on its end close to the pivot shaft, which pinches the link member 13. The brake part 16 restrict excessive deformation of the link member 13.

In addition, the brake part 16 pinches the link member 13 in the width direction of the first guide groove 14. In this way, the movement of the pin 11 is effectively restricted.

Also, the distance W1 between a pair of protrusions of the brake parts 16 is smaller than the width W2 of the link member 13. Thus, the movement of the pin 11 is effectively restricted.

Further, the brake member 15 has the second guide groove 19 in which the pin 11 is inserted and the pin 11 is relatively moved as closing of the cover body 2 is started. Thus, the braking force is gradually increased as the pin 11 approaches the brake parts 16.

Additionally, the second guide groove 19 is shorter than the first guide groove 14. Each of the first and second guide grooves 14, 19 has the linear part, and the width of the linear part of the second guide groove 19 is grater than a diameter D of the pin 11 while a width of the linear part of the first guide groove 14 is smaller than the diameter D of the pin 11. Thus, the braking force is gradually increased as the pin 11 approaches the brake parts 16, and then the brake member 15 is moved by the pin 11 while keeping applying the maximum braking force.

Also, the brake member 15 has the lower inner wall 20 that is capable of supporting the outer circumferential surface of the pin 11 at at least two points. Thus, vibration of the brake member 15 relative to the link member 13 is prevented from occurring.

Further, the lower inner wall 20 is formed in the shape of a letter "V" on a plan view. Thus, vibration of the brake member 15 relative to the link member 13 is effectively prevented from occurring.

In addition, the link member 13 and the brake member 15 are made of different materials having different natural frequency. Thus, vibration of the brake member 15 relative to the link member 13 is effectively prevented from occurring.

Moreover, the image recording apparatus 1 has an image recording device accommodated in the main body 3 and an image reading device accommodated in the cover body 2. Therefore, handling of a paper jam, maintenance of the recording head and exchange of ink cartridges can be easily conducted.

Figure 5:
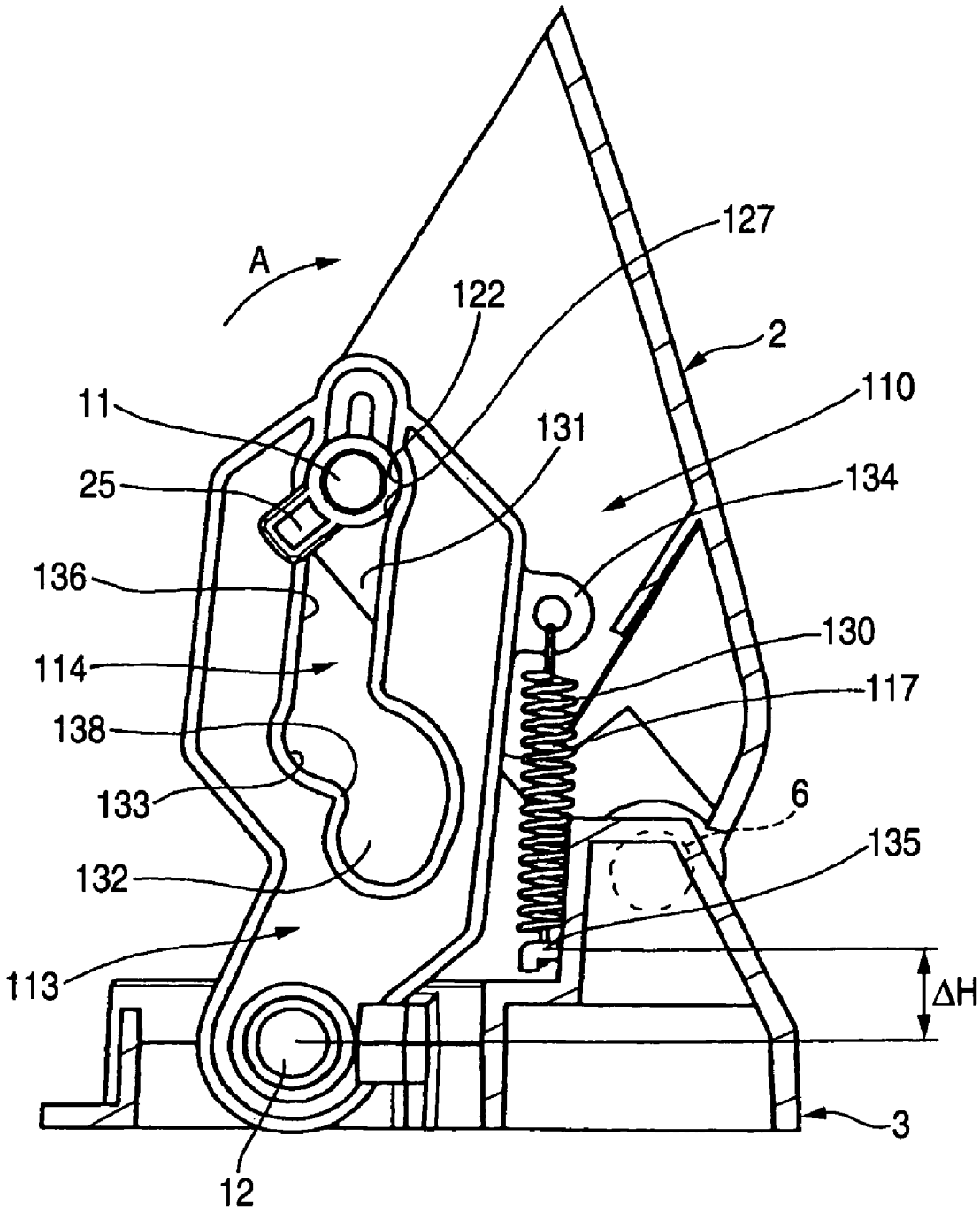
FIG. 5 is an enlarged view of an opening and closing mechanism according to a second embodiment of the invention.
Figure 6A:
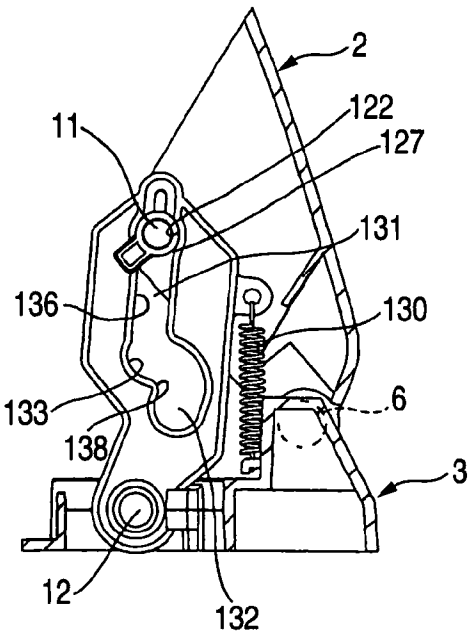
FIGS. 6A to 6C are explanatory views showing an operation of the opening and closing mechanism according to the second embodiment.
Figure 6B:
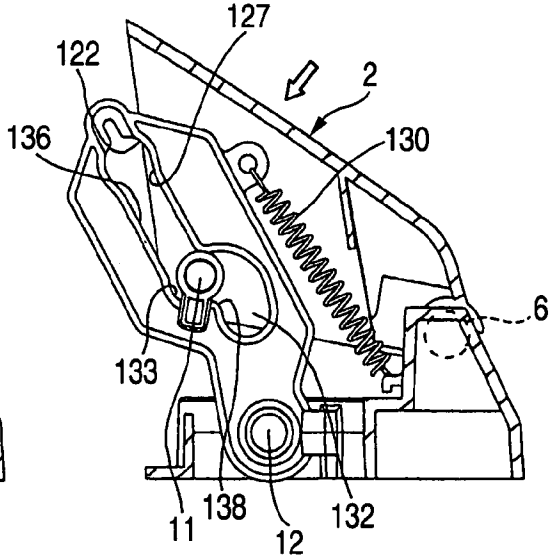
Figure 6C:
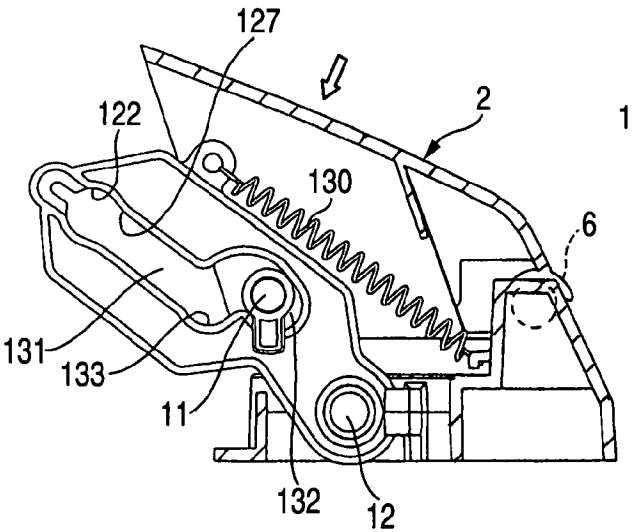

Subsequently, a second embodiment of the present invention will be described with reference to the accompanying drawings. FIG. 5 is an enlarged view of an opening and closing mechanism according to the second embodiment, and FIGS. 6A to 6C are explanatory views showing an operation of the opening and closing mechanism according to the second embodiment. Incidentally, the same reference numerals are attached to the same constituent elements as in the first embodiment, and so the detailed description thereof will be omitted.

An opening and closing mechanism 110 of the second embodiment is applied to the same image recording apparatus 1 as in the first embodiment, which has a circular cross-sectional pin 11 provided in the cover body 2, and a link member 113 pivotably provided in the main body 3 through a pivot shaft 12. The pin 11 is slidably inserted in a guide groove 114 of a substantially oblong shape which is formed to penetrate the link member 113.

A coil spring (which functions as an urging member) 130 for urging the link member 113 to a side where the cover body 3 is opened, is attached between the link member 113 and the main body 3.

The guide groove 114 includes a first groove part 131 that is formed in a substantially linear shape at a location away from the pivot shaft 12, a second groove part 132 that is formed to offset from an extension line of the first groove part 131 toward the hinge 6 (right side of FIG. 5) at a location close to the pivot shaft 12, and a curved part 133 that connects the first and second groove parts 131 and 132. On a tip end side of the link member 113 (i.e., on the side far from the pivot shaft 12), an opening holding part 122 of a substantially circular shape which has a diameter greater than that of the pin 11 is penetratingly formed. An upper narrowed part 127 having a width dimension smaller than that of the first groove part 131 is formed between the opening holding part 122 and the first groove part 131.

In the second embodiment, the link member 113 is shaped in a substantially flat, elongate plate of a synthetic resin. The guide groove 114 is formed in a wide surface of the link member 113 with its length direction matched with that of the link member 113. A width dimension of the first groove part 131, which is a dimension in a direction perpendicular to its length direction, is formed such that the pin 11 slides without rattling. Each width dimension of the curved part 133 and the second groove part 132 is formed to be greater than the diameter of the pin 11. For the sake of convenience, among opposing inner walls defining the width of the first groove part 131, the one far from the hinge 6, namely the surface that is brought into sliding contact with a lower surface side of the pin 11 is defined as "a sliding wall 136." Further, a connection portion between the curved part 133 and the second groove part 132 is defined as "a protrusion 138."

One end of the urging member 130 is engaged with a projected strip part 134 that is formed on a side surface 117 on the side of the hinge 6, among side surfaces of a narrow width which extend along the length direction of the link member 113. The other end of the urging member 130 is engaged with an engaging part 135 that is formed on the side of the main body 3 at a location higher than the pivot shaft 12 of the link member 113 by ΔH. In this manner, regardless of the opening angle of the cover body 2, the link member 113 exerts an urging force in the direction of opening the cover body 2 at all times. Further, in the vicinity of the closed position of the cover body 2, a moment (counterclockwise moment in FIG. 6C) caused by the self-weight of the cover body 2 (in the closing direction of the cover body 2) is set to become greater than that (clockwise moment in FIG. 6C) caused by the urging member 130 for pivoting the cover body 2 in the opening direction. Consequently, a lock mechanism for maintaining a closed state of the cover body 2 is not required.

According to the above configuration, as shown in FIG. 6A, when the cover body 2 is in an opened state relative to the main body 3, the pin 11 is positioned at the opening holding part 122 of the guide groove 114. Because the upper narrowed part 127 is formed between the opening holding part 122 and the first groove part 131, the pin 11 is stably maintained in the opening holding part 122, and the cover body 2 maintains that opened state while the operator performs the necessary maintenance work.

When a force is applied to the cover body 2 in the closing direction, the pin 11 moves from the opening holding part 122 to the first groove part 131 through the upper narrowed part 127. Because the pin 11 passes through the upper narrowed part 127 when moving into the first groove part 131, the pin 11 gives a tactile response to the operator as the closing operation of the cover body 2 is started.

The pin 11 slides along the first groove part 131 of the guide groove 114 in accordance with the closing operation of the cover body 2 which is caused by its self-weight. During this time, because the link member 113 always attempts to pivot in an erect direction (direction of opening the cover body 2) due to the urging force by the urging member 130, the pin 11 slides on the sliding wall 136 on the lower surface side of the first groove part 131. Therefore, the cover body 2 gradually approaches the upper surface of the main body 3. Further, when arriving at the curved part 133, the pin 11 is brought into contact with an inner wall of the curved part 133 extending from the sliding wall 136. In addition, because the link member 113 is always urged to the opening side (arrow A in FIG. 5) of the cover body 2 by the urging member 130, force is exerted to the pin 11 to make the pin 11 come into contact with the inner wall of the curved part 133. In other words, the curved part 133 serves as a cam, and the cover body 2 comes to a stop temporarily during the closing operation.

In this state, when the operator intends to close the cover body 2, he/she further presses down the cover body 2. At this time, as shown in FIG. 6B, the pin 11 moves to the second groove part 132 passing the protrusion 138. Because the curved part 133 and the second groove part 132 are smoothly connected, and have the width dimension greater than the diameter of the pin 11, the load required when the operator presses down the cover body 2 to completely close it is reduced. Further, as shown in FIG. 6C, the cover body 2 slowly closes while balancing the urging force of the urging member 130 with the self-weight of the cover body 2.

On the contrary, the operator pulls up the cover body 2 when intending to open the cover body 2. In this case, the pin 11 moves along the second groove part 132 to the curved part 133 passing the protrusion 138, thus is brought into contact with a bottom of the curved part 133. At this time, because the urging force of the urging member 130 acts on the link member 113 to guide the pin 11 to the first groove part 131, the pin 11 quickly moves to the first groove part 131 without temporarily being stopped at the curved part 133. Further, the pin 11 slides along the sliding wall 136 of the first groove part 131 on the side away from the pivot shaft 12. During this time, because the urging member 130 urges the link member 133 to the side where the cover body 2 is opened, the operator only needs to lightly apply a force to the cover body 2 (According to setup of the urging force, the load of the operator may not be required.) When the pin 11 reaches the upper narrowed part 127, and the operator applies additional force in the opening direction of the cover body 2, the pin 11 reaches the opening holding part 122 while giving the tactile response to the operator, and the cover body 2 is maintained in the opened state.

In the opening and closing mechanism 110 according to the second embodiment, the closing operation of the cover body 2 is automatically stopped temporarily on the way. Thus, when closing the cover body 2, there is no fear that the operator's fingers are pinched by the cover body 2 or any precision parts are damaged by impact.

Further, in order to transfer the cover body 2 from the temporary stopped state to the completely closed state, the cover body 2 is pressed so that the pin 11 goes beyond the protrusion 138. Thus, this operation gives the tactile response which facilitates recognition that the cover body 2 is in the closed state.

As described above, the urging member 130 urges the cover body 2 via the link member 113 in the opening direction of the cover body 2. The guide groove 114 has the first groove part 131 that extends substantially linearly and the curved part 133 that is connected to the end, close to the pivot shaft 12, of the first groove part 131 and extends in a direction that crosses the first groove part 131. In this way, the urging member 130 can brake the closing operation of the cover body 2, without braking the opening operation of the cover body 2.

Further, the width of the curved part 133 is grater than the diameter D of the pin 11. Therefore, the opening of the cover body 2 can be conducted smoothly.

In addition, the urging force of the urging member 130 for urging the cover body 2 is set such that a moment caused by the self-weight of the cover body 2 in the closing direction becomes larger than the moment caused by the urging force in the opening direction after the pin 11 is brought into contact with the inner wall of the curved part 133. Thus, the cover body 2 can be kept closed without requiring additional locking parts.

Furthermore, in closing the cover body 2, the pin 11 is brought into contact with the sliding wall 136 of the opposing inner walls that define the width of the curved part 133 by the urging force of the urging member 130 which exerts in the opening direction. The sliding wall 136 is located at a side closer to the main body 3 than the other of the inner walls. In this way, the closing operation of the cover body 2 is effectively restricted.

Incidentally, in the first and second embodiments, the pin 11 and the link member 13 (or 113) are provided in the cover body 2 and the main body 3, respectively. Of course, the pin 11 and the link member 13 (or 113) may be provided in the main body 3 and the cover body 2, respectively. In this case, the guide groove 14 (or 114) and the brake member 15 have a shape turned upside down. This configuration achieves the same effects as well.

In addition, it does not matter that the opening and closing mechanism 10 (or 110) is provided at the both ends (a pair) of a shaft of the hinge 6 or either of the both ends. When the opening and closing mechanism is provided on either of the both ends, it is necessary to provide a known link mechanism for assisting operation of the cover body 2 on the other end.

What is claimed is:

1. An opening and closing mechanism that attaches a cover body to a main body in a manner that the cover body is pivotably opened and closed, comprising:

a pin provided in one of the main body and the cover body;

a link member pivotably provided in the other of the main body and the cover body, the link member having a first guide groove in which the pin is inserted and the pin slides with respect to the main body during closing and opening of the cover body; and a close motion braking member that is a separate member from the pin and the link member and is connected to the link member, the close motion braking member applying an external force to the link member to brake sliding of the pin in the first guide groove during closing of the cover body.

2. The opening and closing mechanism according to claim 1, wherein the pin has an engaging piece that prevents the pin from coming off the first guide groove.

3. The opening and closing mechanism according to claim 1, wherein the first guide groove includes a first inner wall and a second inner wall, where the pin is located between the first inner wall and the second inner wall.

4. The opening and closing mechanism according to claim 1, wherein the first guide groove has an opening holding part that holds the cover body in an opened state, the opening holding part being formed into a substantially circular shape and located at one end of the first guide groove which is distal to a pivoting axis of the link member.

5. The opening and closing mechanism according to claim 4, wherein the first guide groove has a closing holding part that holds the cover body in a closed state, the closing holding part being formed into a substantially circular shape and located at the other end of the first guide groove which is close to the pivoting axis of the link member.

6. The opening and closing mechanism according to claim 1, wherein the close motion braking member is externally fit on the link member and is slid on the link member in accordance with a movement of the pin relative to the link member.

7. The opening and closing mechanism according to claim 6, wherein the link member and the close motion braking member are made of different materials having different natural frequency.

8. The opening and closing mechanism according to claim 6, wherein the close motion braking member has a brake part on its end that is close to a pivoting axis of the link member, the brake part pinching the link member.

9. The opening and closing mechanism according to claim 8, wherein the brake part pinches the link member in a width direction of the first guide groove which is perpendicular to a length direction of the first guide groove.

10. The opening and closing mechanism according to claim 9, wherein the brake part has a pair of protrusions for pinching the link member therebetween; and a distance between the pair of the protrusions is smaller than a width of the link member.

11. The opening and closing mechanism according to claim 8, wherein the close motion braking member has a second guide groove in which the pin is inserted and the pin is relatively moved as closing of the cover body is started.

12. The opening and closing mechanism according to claim 11, wherein the second guide groove is shorter than the first guide groove;

each of the first and second guide grooves has a linear part; and a width of the linear part of the second guide groove is greater than a diameter of the pin while a width of the linear part of the first guide groove is smaller than the diameter of the pin.

13. The opening and closing mechanism according to claim 11, wherein the close motion braking member has an inner wall that defines the second guide groove, the inner wall being capable of supporting an outer circumferential surface of the pin at at least two points at an end of the second guide groove which is close to the pivoting axis of the link member.

14. The opening and closing mechanism according to claim 13, wherein the inner wall is formed in the shape of a letter "V" on a plan view at the end of the second guide groove.

15. The opening and closing mechanism according to claim 1, wherein the close motion braking member comprises an urging member that urges the cover body via the link member in a direction of opening the cover body; and the first guide groove has a linear part that extends substantially linearly and a curved part that is connected to an end of the linear part, which is close to a pivoting axis of the link member, and extends in a direction that crosses the linear part.

16. The opening and closing mechanism according to claim 15, wherein a width of the curved part is greater than a diameter of the pin.

17. The opening and closing mechanism according to claim 15, wherein an urging force of the urging member for urging the cover body is set such that a moment caused by a self-weight of the cover body in a direction of closing the cover body becomes larger than a moment caused by the urging force in the direction of opening the cover body after the pin is brought into contact with an inner wall of the curved part.

18. The opening and closing mechanism according to claim 15, wherein, in closing the cover body, the pin is brought into contact with one of opposing inner walls that define a width of the curved part by an urging force of the urging member which exerts in the direction of opening the cover body, the one of the inner walls being located at a side closer to the main body than the other of the inner walls.

19. An image recording apparatus comprising:

a main body;

a cover body; and the opening and closing mechanism according to claim 1.

20. The image recording apparatus according to claim 19, further comprising: an image recording device accommodated in the main body; and an image reading device accommodated in the cover body.

* * * * *